US006245710B1

(12) United States Patent
Hare et al.

(10) Patent No.: US 6,245,710 B1
(45) Date of Patent: Jun. 12, 2001

(54) IMAGING TRANSFER SYSTEM AND PROCESS FOR TRANSFERRING A THERMAL RECORDING IMAGE TO A RECEPTOR ELEMENT

(75) Inventors: Donald S. Hare; Scott A. Williams, both of Hawley, PA (US)

(73) Assignee: Foto-Wear, Inc., Milford, PA (US)

( * ) Notice: Subject to any disclaimer, the term of this patent is extended or adjusted under 35 U.S.C. 154(b) by 0 days.

(21) Appl. No.: 09/191,369

(22) Filed: Nov. 13, 1998

Related U.S. Application Data

(60) Provisional application No. 60/065,804, filed on Nov. 14, 1997.

(51) Int. Cl.[7] ..... B41M 5/26; B41M 5/30; B41M 5/34

(52) U.S. Cl. ..... 503/201; 428/195; 428/207; 428/321.5; 428/327; 428/484; 428/488.4; 428/913; 428/914; 503/215

(58) Field of Search ..... 503/215, 226, 503/201; 428/195, 207, 212, 913, 914, 484, 321.5

(56) References Cited

U.S. PATENT DOCUMENTS

| | | | |
|---|---|---|---|
| 1,799,754 | 4/1931 | Lawrence | 428/175 |
| 2,596,754 | 5/1952 | Yackel | 95/5 |
| 3,219,446 | 11/1965 | Berman | 96/28 |
| 3,700,439 | 10/1972 | Phillips, Jr. | 96/27 R |
| 4,064,285 | 12/1977 | Mammino | 427/24 |
| 4,201,404 | 5/1980 | Charbonneau et al. | 282/27.5 |
| 4,224,358 | 9/1980 | Hare | 427/147 |
| 4,284,456 | 8/1981 | Hare | 156/234 |
| 4,351,871 | 9/1982 | Lewis et al. | 428/195 |
| 4,555,436 | 11/1985 | Guertsen et al. | 428/200 |

(List continued on next page.)

FOREIGN PATENT DOCUMENTS

| | | |
|---|---|---|
| 0649753 A1 | 4/1995 | (EP) . |
| 0820874-A1 | 1/1998 | (EP) . |
| 0260129A2 | 3/1998 | (EP) . |

(List continued on next page.)

OTHER PUBLICATIONS

Instructions for Use—Copyfantasy CTM 50, Messerli Information Technology (Mouse–pads, T–shirts, cotton bags, etc.).

"Using Canon T–Shirt Transfers TR–101," 1995 Canon Computer Systems, Inc. form CST–4051–002.

(List continued on next page.)

*Primary Examiner*—Bruce H. Hess
(74) *Attorney, Agent, or Firm*—Birch, Stewart, Kolasch & Birch, LLP

(57) ABSTRACT

The present invention relates to an imaging system, which comprises a support having a front and rear surface, at least one transfer layer coated on the front surface of the support, and at least one thermal recording layer coated on top of the outermost transfer layer, wherein the thermal recording layer contains heat-responsive microcapsules capable of separating an inner phase within the microcapsules from an outer phase contained outside the microcapsules, wherein said inner phase is capable of reacting with said outer phase to create a color forming element, and wherein the transfer layer is capable of transferring and adhering an image from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external adhesive layer, with the proviso that the transfer layer is not capable of reacting to form an image

24 Claims, 1 Drawing Sheet

U.S. PATENT DOCUMENTS

| | | | |
|---|---|---|---|
| 4,715,914 | 12/1987 | Viner | 156/94 |
| 4,751,165 | 6/1988 | Rourke et al. | 430/138 |
| 4,773,953 | 9/1988 | Hare | 156/240 |
| 4,808,565 | 2/1989 | Whitcomb et al. | 503/211 |
| 4,879,175 | 11/1989 | Ugro, Jr. | 428/321.5 |
| 4,966,815 | 10/1990 | Hare | 428/497 |
| 4,980,224 | 12/1990 | Hare | 428/202 |
| 5,019,475 | 5/1991 | Higashiyama et al. | 430/138 |
| 5,032,449 | 7/1991 | Strom | 428/195 |
| 5,098,772 | 3/1992 | Strom | 428/211 |
| 5,139,917 | 8/1992 | Hare | 430/138 |
| 5,236,801 | 8/1993 | Hare | 430/199 |
| 5,242,739 | 9/1993 | Kronzer et al. | 428/200 |
| 5,271,990 | 12/1993 | Kronzer et al. | 428/195 |
| 5,296,331 | 3/1994 | Taguchi | 430/253 |
| 5,407,729 | 4/1995 | Verden et al. | 428/196 |
| 5,419,944 | 5/1995 | Sammis | 428/147 |
| 5,424,141 | 6/1995 | Croner | 428/195 |
| 5,501,902 | 3/1996 | Kronzer | 428/323 |
| 5,545,505 | 8/1996 | Simpson | 430/250 |
| 5,558,983 | 9/1996 | Simpson et al. | 430/619 |
| 5,597,557 | 1/1997 | Kumar et al. | 424/70.17 |
| 5,612,168 | 3/1997 | Ishikawa | 430/263 |
| 5,620,548 | 4/1997 | Hare | 156/239 |
| 5,670,446 | 9/1997 | Jubran et al. | 503/201 |
| 5,798,179 | 8/1998 | Kronzer | 428/411.1 |
| 5,846,901 | 12/1998 | Jubran | 503/201 |
| 5,948,586 | 9/1999 | Hare | 430/138 |

FOREIGN PATENT DOCUMENTS

| | | |
|---|---|---|
| 2452381 | 10/1980 | (FR) . |
| 2690873 | 11/1993 | (FR) . |
| 1216613 | 12/1970 | (GB) . |
| 2187298A | 3/1987 | (GB) . |
| 220264 1A | 9/1988 | (GB) . |
| 50-62700 | 5/1975 | (JP) . |
| 50-108010 | 8/1975 | (JP) . |
| 50-108011 | 8/1975 | (JP) . |
| 63-137897 | 6/1988 | (JP) . |
| 63-173054 | 7/1988 | (JP) . |
| 8704393 | 7/1987 | (WO) . |
| 9103766 | 3/1991 | (WO) . |
| 9321561 | 10/1993 | (WO) . |
| 97/33763 | 9/1997 | (WO) . |
| 98/21398 | 5/1998 | (WO) . |

OTHER PUBLICATIONS

Hard Copy Supplies Journal, Apr. 1996 edition, "*Messerli Debuts State–of–the–Art Media for Ink Jet, Laser*", pp. 16–17.

Hard Copy Supplies Journal, Apr. 25, 1997 edition, "*Messerli Developments Keep Coming*", p. 37.

IMAGING TRANSFER SYSTEM AND PROCESS FOR TRANSFERRING A THERMAL RECORDING IMAGE TO A RECEPTOR ELEMENT

The contents of Provisional Application U.S. Ser. No. 60/065,804 filed Nov. 14, 1997, on which the present application is based and benefit is claimed under 35 USC 119 (e), is herein incorporated by reference.

BACKGROUND OF THE INVENTION

1. Field of the Invention

The present invention relates to a transfer element, using direct thermal full color recording and similar technology, and to a method of transferring image areas to a receptor element.

2. Description of the Prior Art

Direct thermal full color recording technology of Fuji Photo Film Co., Ltd. (i.e. THERMO-AUTOCHROME), provides full color imaging with high resolution and photo-quality print with vivid color and rich tonal gradation. U.S. Pat. No. 4,771,032 discloses a thermal recording system, which is a direct thermal full color hardcopy system involving thermal media capable of producing color images with the use of microcapsules.

Direct thermal full color recording technology may utilize a diazonium salt compound as a color forming material.

Technologies surrounding image-receptive transfer paper are known in the art, such as those disclosed in U.S. Pat. Nos. 4,224,358, 4,284,456, 4,773,953, 4,966,815, 4,980, 224, 4,555,436, 4,235,657, 4,863,781, 5,242,739, 5,271,990, and 5,501,902, incorporated herein by reference.

U.S. Pat. No. 5,620,548 is directed to a silver halide photographic transfer element and to a method for transferring an image from the transfer element to a receptor surface. Provisional application Ser. No. 60/029,917 requires that the silver halide light-sensitive grains are dispersed within a carrier which functions as a transfer layer, and does not have a separate transfer layer. Provisional application Ser. No. 60/056,446 requires that the silver halide transfer element has a separate transfer layer. Provisional application Ser. No. 60/030,933 relates to a transfer element using Cycolor technology, but having no separate transfer layer.

U.S. Pat. No. 4,751,165 discloses an imaging system which provides an imaging sheet and a layer of microcapsules containing a photosensitive composition and a color former. However, the developed image and non-image areas thereof are not capable of being simultaneously transformed to a receptor element.

Accordingly, imaging systems based on photosensitive encapsulates are known. U.S. Pat. No. 3,219,446 by Berman discloses the selected transfer of dye to a capsule sheet. U.S. Pat. No. 3,700,439 by Phillips discloses a photocopy process involving development of capsules without transfer.

U.S. Pat. No. 4,711,032 discloses a thermo-autochrome system, which is a direct thermal full color hardcopy system involving thermal media capable of producing color images with the use of microcapsules.

U.S. Pat. No. 5,139,917 discloses an imaging system wherein the developed image and non-image areas are transferred to a receptor element by a separate transfer coating layer.

SUMMARY OF THE INVENTION

An object of the present invention is to coat the direct thermal recording image layer(s) onto a transfer layer of the invention which is capable of heat-transferring said layer to a receptor element.

A second object of the present invention is to make a self-contained transfer sheet utilizing direct thermal recording technology. The desired image and non-image areas can then be transferred to a receptor element such as an article of clothing by means of heat and/or pressure, after which the support is removed.

Accordingly, the present invention is directed to an imaging system which comprises, a support having a front and rear surface, at least one layer of heat activated transfer layer and at least one direct thermal recording layer, on said front surface of the support, wherein said direct thermal recording layer is preferably situated on top of the heat activated transfer layer of the invention, said transfer layer preferably having a melting point of approximately 50° C. to 180° C., preferably greater than 100° C. and most preferably between 100° C. and 120° C., and being capable of transferring and adhering a developed image and non-image areas from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external (e.g. surface) adhesive layer and preferably occurs in an area at least coextensive with the area of said microcapsules. Preferably, the particle size of the transfer layer is the same as or smaller than that of the microcapsules of the direct thermal recording layer, for example, from 1– 50 micrometers, preferably from 1–20 micrometers, and more preferably less than 10 micrometers.

The receptor surface for the image may be a textile such as a shirt (e.g. tee shirt), leather, ceramic, wool, glass or plastic or the like. Other suitable receptor surfaces include canvas, paper, or receptor supports used by the museum or conservatory industry. Preferably, the receptor element is a shirt or the like. Energy applied to the rear surface of the element is heat and/or pressure (e.g via ironing).

Accordingly, the transfer layer of the invention does not contain said microcapsules, and is most preferably located between the support and the microcapsule-containing direct thermal recording imaging element.

The present invention also relates to a method of applying an image to a receptor element, which comprises the steps of:

(a) forming an image on the direct thermal recording imaging element described above, (b) positioning the front surface of said image against said receptor element, and (c) applying energy (e.g heat) to the rear surface of the element to transfer the image to said receptor element.

The receptor element may be a textile, leather, ceramic, wool, glass or plastic. Preferably, the receptor element is a shirt or the like. Energy applied to the rear surface of the imaging system is heat and/or pressure (e.g. via ironing).

BRIEF DESCRIPTION OF THE DRAWINGS

The present invention will become more fully understood from the detailed description given hereinbelow, and the accompanying drawings which are given by way of illustration only, and thus are not limitative of the present invention, and wherein:

FIG. 2 illustrates the step of ironing the imaging sheet or element onto a tee shirt or the like.

DETAILED DESCRIPTION OF THE INVENTION

Figure 1:
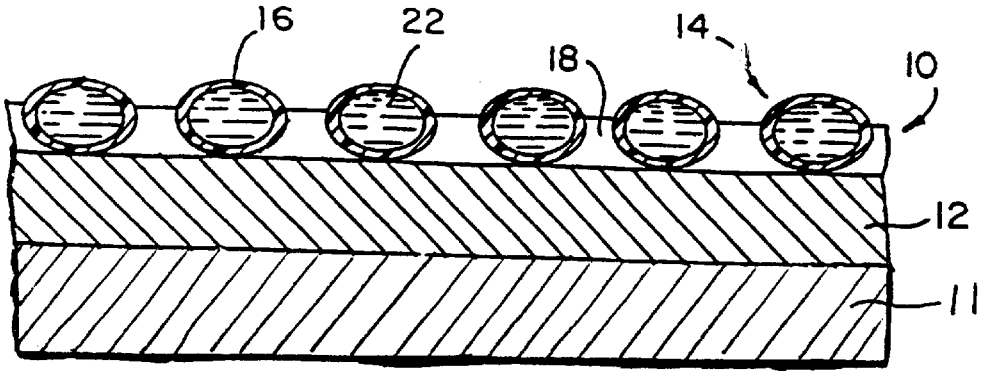
FIG. 1 is a cross-sectional view of the preferred embodiment of an imaging sheet or element of the present invention.

In the preferred embodiment of the invention, a thermal recording material is prepared by coating a heat responsive microcapsule containing a diazonium salt compound, a coupler, and a reaction-accelerating organic base, above the transfer layer of the invention, said transfer layer being coated on a substrate. Upon heating at a selected predetermined temperature so that the transfer layer does not melt, the coupler and organic base diffuse into the microcapsule and a coupling reaction occurs to form an azo dye. Then, the entire print is irradiated with light, the wavelength of which corresponds to the absorption of the diazonium salt compound. Unused diazonium salt compound is photodecomposed and the image is fixed.

In another embodiment of the invention, a thermal recording material is prepared by coating a heat-responsive microcapsule containing an oxidizable dye precursor in combination with a photo-radical generator, and a reducing agent (radical quencher), optionally in one or more layers on top of a substrate having the transfer layer of the invention thereon. Upon heating at a selected predetermined temperature so that the transfer layer does not melt, the reducing agent diffuses into the microcapsule to form a latent image. The entire print is irradiated with light wherein the wavelength thereof corresponds to the absorption of the radical generator in each capsule, forming a radical. The radical is deactivated in a heated microcapsule by the reducing agent which diffused into the capsule, and no color formation occurs. The oxidizable dye precursor is oxidized by the radical (dehydrogenation) in an unheated microcapsule and a color is obtained. Upon heating again, no color change occurs and the print is fixed.

In another embodiment, a thermal recording material is prepared by coating a microcapsule containing an organic cationic-dye borate anion salt compound (e.g. colored compound) and an organic acid optionally in one or more layers on a substrate having the transfer layer of the invention thereon. Upon heating at a selected predetermined temperature so that the transfer layer does not melt, the organic acid diffuses into the microcapsule and reacts with the borate anion to form a latent image. The entire print is irradiated with light wherein the wavelength thereof corresponds to the absorption of the dye salt. In an unheated capsule, the dye salt is activated and decolorizes (photobleaching). The borate anion is decomposed beforehand in a heated capsule and the photobleaching does not occur. Thus, photobleaching takes place in the unheated portion. Because photobleaching is irreversible, no color change occurs by successive heating or irradiation with light, and the print is fixed.

In a further embodiment of the invention, a thermal recording material is prepared by coating a heat responsive microcapsule containing a basic leuco dye (color former), a liquid vinyl monomer and a photo radical generator, with a phenolic color developer optionally in one or more layers, on a substrate having the transfer layer of the invention thereon. Upon heating at a selected predetermined temperature so that the transfer layer does not melt, the color developer diffuses into the microcapsule and reacts with the color former to form a dye. Then, the entire print is irradiated with light wherein the wavelength corresponds to the absorption of the photo-radical generator, and the vinyl monomer in the microcapsule polymerized and solidified.

In a still further embodiment of the invention, a recording material is prepared by coating a heat responsive microcapsule containing a basic leuco dye and a phenolic color developer having a polymerizable vinyl group, optionally in multiple layers, having thereon the transfer layer of the invention on a substrate.

Of the above-mentioned methods, the diazonium salt compound method is preferred. Usami et al., "The Development of Direct Thermal Full Color Recording Material", *J. Inf. Recording,* 1996, Vol. 22, pp. 347–357.

To obtain a full color print, the thermal recording material comprises a base support, a cyan color forming layer, a magenta color forming layer, a yellow color forming layer and an optional protective coating. The transfer layer of the invention is a separate layer above the substrate and below these color forming layers. The innermost color forming layer preferably is composed of a basic leuco dye and a phenolic compound developer, which reacts to form a cyan dye. The basic leuco dye is encapsulated in a heat responsive microcapsule. The magenta-color forming layer is composed of an encapsulated diazonium salt compound which decomposes when exposed to 365 nm ultraviolet light, an organic base, and a coupler, reacting to form a magenta azo dye. The yellow-color forming layer is composed of an encapsulated diazonium salt compound which decomposes when exposed to 420 nm ultraviolet light, an organic base, and a coupler, reacting to form a yellow azo dye.

The heat-responsive microcapsule in the yellow-color forming layer has a high thermo sensitivity and therefore responds to low thermal energy. The heat-responsive microcapsule in the magenta-color forming layer has a mid-range thermo sensitivity, and the heat-responsive microcapsule in the cyan color forming layer has a low thermo sensitivity.

A full color print can be obtained in a five-step process. First, the yellow color forming layer reacts to low levels of thermal energy to generate the yellow portion of the image. Second, the entire print is exposed with a 420 nm ultraviolet lamp which decomposes the diazonium salt compound remaining in the yellow-color forming layer. This exposure fixes the yellow-color forming layer. Third, the magenta-color forming layer reacts to mid-range levels of thermal energy to generate the magenta portion of the image. Fourth, the entire print is exposed with a 365 nm ultraviolet lamp, which decomposes the diazonium salt compound remaining in the magenta-color forming layer. Finally, the cyan-color forming layer reacts to high levels of thermal energy to generate the cyan portion of the image.

The diazonium salt compound in the yellow color forming layer has two photosensitivity peaks, at 355 nm and 420 nm. The diazonium salt compound in the magenta color forming layer has a photosensitivity peak at 365 nm. So, exposure with 420 nm ultraviolet light can selectively decompose the diazonium salt compound in the yellow color forming layer A subsequent exposure to 365 nm ultraviolet can decompose the diazonium salt compound in the magenta color forming layer.

A diazonium salt compound gives both thermo sensitive and light fixable properties to the yellow and magenta-color forming layers. The diazonium salt compound is dissolved in core oil and encapsulated in a microcapsule. The diazonium salt compound is thus completely isolated from the coupler and the organic base, making it stable over a long period of the time.

The coupler is used preferably in an amount of from 0.1 to 30 parts by weight per part by weight of the diazo compound. The organic base is used preferably in an amount of from 0.1 to 30 parts by weight per part by weight of the diazo compound.

The wall of the microcapsule is preferably poly(urea/urethane). It is known that the poly(urea/urethane) wall membrane of a microcapsule becomes permeable above its glass transition temperature (Tg). When the color forming layer is heated above the Tg of the wall of the capsule, a coupler and an organic base instantly permeate the wall and react with the diazonium salt compound in a core oil to form dye.

All color forming materials must be water insoluble and oil soluble. The diazonium salt compounds and the basic leuco dye are dissolved in core oils and encapsulated. If the water solubility of these materials is too high, excessive amounts of the materials will escape to the outside of the capsule's wall. Leaking color forming material causes color forming reactions and increases background density. The couplers and the phenolic compound developers are also dissolved in a hydrophobic solvent and emulsified in a carrier conventional in this art. Water soluble couplers and phenolic compound developers tend to diffuse into the other color forming layers and cause undesirable color forming reactions during imaging.

To make diazonium salt compounds water insoluble, a counter ion of the diazonium must be selected from hydrophobic groups such as $C_8H_{17}SO_3^-$, $2PF_6^-$, $BF_4^-$ or $B(phenyl)_4^-$, and hydrophobic substituents must be introduced to the structure.

The maximum wave length of a diazonium salt compound is controlled by introducing a substituent group in an aromatic ring of a benzenediazonium structure. It is known that the introduction of an electron-donating substituent group increases the maximum absorption wave length.

The color hues of the azo dyes, which are formed in the yellow and magenta-color forming layers, depends on both the diazonium salt compounds and the couplers. The color hue of the basic dye; however, is almost completely dependent on the basic leuco dye.

The image quality is evaluated with the FUJIX FOTOJOY PRINTER NC-1.

In the thermal processing transfer systems of the present invention, the melting point of the transfer layer may be selected as desired. For instance, in order that the transfer layer should not melt during the imaging of the thermal sensitive microcapsules, the material chosen for the transfer layer should have a melting point which will survive the imaging of the material. Then, the transfer layer will only melt during transfer of the image. However, if for some reason it is desired to have the transfer layer melt during the image fixing steps, the compositions of the transfer layer and/or microcapsule may be altered through routine experimentation.

Heat sensitive recording materials are known in the art. Thus, the invention is applicable to such materials and include, for instance, materials disclosed in U.S. Pat. Nos. 5,661,101, 5,593,938, 5,543,260, 5,525,571, 5,514,636, 5,494,772, 5,492,789, 5,486,446, 5,410,335, 5,409,880, 5,409,797, 5,407,777, 5,338,642, 5,328,796 5,304,452, 4,857,941, 4,760,048, 4,464,376, and references cited therein.

Direct thermal recording technology is the preferred mode of image formation according to the present invention.

The term "encapsulated" refers to both so-called resin dispersion or open phase systems in which the internal phase containing a chromogenic material is dispersed as droplets throughout a dispersing medium (e.g. carrier) and systems in which the capsule is formed with a discrete capsular wall, the latter encapsulation typically being in the form of microcapsule.

The term "microcapsule" includes both microcapsules having discrete walls and microcapsules within a so-called open phase system comprising a dispersion of the internal phase constituents in a binder.

The term "actinic radiation" includes the entire electromagnetic spectrum including ultraviolet (U.V.) and infrared (I.R.) radiation.

Typically, direct thermal recording printers utilize a paper containing a vast number of colored microcapsules which, when exposed to varying degrees of energy (e.g. heat, light) form a color image. In the present invention the layer(s) containing the microcapsules is coated on top of the transfer layer which is coated on top of the base support layer. As a result of the invention, the transfer layer will release under energy (e.g. heat) and carry the image to the receptor element (e.g. textile) in washproof color.

Therefore, by using a single self-contained imaging sheet comprising (a) a support,
(b) at least one transfer layer of the invention,
(c) at least one direct thermal recording layer containing microcapsules, and
(d) an optional layer of clear thermoplastic, the image may be directly transferred to a receptor element (e.g. textile).

A representative element of the invention is set forth in FIG. 1. The layer containing microcapsules preferably comprises at least three layers of its own, specifically, a yellow color forming layer, a magenta color forming layer and a cyan color forming layer.

Each imaging layer contains its own direct thermal recording microcapsules. As mentioned above, the diazonium salt compounds and the basic leuco dye are dissolved in core oils and are encapsulated within the microcapsules. Additionally, the couplers and the phenolic compound developers are also dissolved in a hydrophobic solvent and emulsified in gelatin binder.

Representative developer containing resins include phenolic developer resins, as described in U.S. Pat. No. 4,751,165.

The developer-containing resin and microcapsule composition can be coated using conventional coating techniques such as blade coating, roll coating, etc.

The receptor surface for the image and non-image areas is preferably a textile such as a shirt (e.g., tee shirt) or the like. However, any receptor capable of receiving the imaging material (e.g. image and non-image areas) of the imaging sheet and imparting the desired washproof properties is within the scope of the invention. Other suitable receptor surfaces include canvas, wool, plastic, ceramic, leather, paper, glass or receptor supports used by the museum or conservatory industry.

The support material comprises a suitable support or substrate which may be any type of known material ordinarily used as a support for imaging materials (e.g. paper, plastic coated papers, PET resins, etc.). The transfer layer which can be transferred to a receptor surface is coated on the support or substrate. The thermal recording layer is then coated thereon.

One requirement of a transfer layer of the invention is that it adhere strongly to fibrous supports, and optionally to glassy supports. Moreover, the transfer layer of the invention should preferably be "inert" so that it does not degrade the image. However, in view of the short life of T-shirts having images thereon, less expensive materials that are not entirely inert may be used to save cost.

The transfer layer of the invention must also be capable of transfer from the support (e.g. imaging sheet) and adherence to a receptor element without the requirement of a separate surface adhesive layer. Without being bound by any theory, upon back surface heating of the support, the transfer layer would undergo a solid to solution phase transition resulting in a transfer to the receptor element. Edge to edge adhesion, to the receptor element, would occur upon cooling of the transfer material onto the receptor element. Upon cooling, an image layer would be completely transferred onto the receptor element. The transfer layer material provides mechanical and thermal stability, as well as washability The transfer layer should provide a colorfast image (e.g. washproof or wash resistant) when transferred to the receptor surface. That is, upon washing the receptor element (e.g. tee shirt), the image should remain intact on the receptor element.

Suitable transfer layers of the invention are exemplified below. However, it is easy to screen for suitable transfer layers without undue experimentation in view of the performance criteria discussed in this application. For instance, see the Examples discussed below for suitable screening protocol. Further, the transfer layers of the invention may be mixed with conventional carriers so long as the amount of conventional carrier does not adversely affect the transfer properties of the carrier. The optional, clear thermoplastic protective material of the invention includes, for instance, vinyl resins such as ethylene/vinyl acetate copolymers, resin esters, vinyl alcohol/vinyl acetate copolymers, vinyl alkyl ether/maleic anhydride copolymers, polyvinyl chloride, vinyl chloride/vinyl acetate copolymers and the like, acrylic resins such as polyethyl acrylate, polybutyl methacrylate, polymethyl cyanoacrylate and the like, styrene resins, polyamide resins and waxes. The selected thermoplastic material should liquify under heat during transfer and resolidify when cool. This material protects against abrasion and inadvertent exposure to water. When the optional thermoplastic protective layer is employed, said protective layer is exemplified by U.S. Pat. No. 5,661,101.

Suitable transfer layer materials include compositions comprising materials from U.S. Pat. Nos. 5,501,902, 5,271,990, 5,242,739 and 5,798,179. The contents of U.S. Pat. Nos. 5,501,902, 5,271,990, 5,242,739, and 5,798,179 are herein incorporated by reference. These patents are discussed in turn hereinbelow.

One of the transfer layers of the present invention utilizes the materials of the second layer of U.S. Pat. No. 5,501,902.

The transfer layer preferably includes particles of a thermoplastic polymer having dimensions of from about 1 to about 50 micrometers, preferably from about 1 to about 20 micrometers. The particles will more preferably have dimensions of from about 2 to about 10 micrometers. In general, the thermoplastic polymer can be any thermoplastic polymer which meets the criteria set forth herein. Desirably, the powdered thermoplastic polymer will be selected from the group consisting of polyolefins, polyesters, and ethylene-vinyl acetate copolymers.

The transfer layer also includes from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the transfer layer includes a cationic polymer, a nonionic or cationic dispersion or solution may be employed as the binder. Suitable binders include polyacrylates, polyethylenes, and ethylenevinyl acetate copolymers. The latter are particularly desired because of their stability in the presence of cationic polymers. The binder desirably will be heat softenable at temperatures of about 120° Celsius or lower.

The basis weight of the transfer layer may vary as desired, but preferably the transfer layer is present in an amount from about 5 to about 30 g/m$^2$. Desirably, the basis weight will be from about 10 to about 20 g/m$^2$. The transfer layer can be applied to the support, either directly or over another layer, by means well known to those having ordinary skill in the art. For example, the layer may be applied by curtain coating, Meyer rod, air knife, and gravure coating, by way of illustration only.

When the imaging sheet or element is intended to be used as a heat-transfer material as is the case in the present invention, the transfer layer will have a melting point of from about 65 to about 180 degrees Celsius, preferably from about 100 to 180 degrees Celsius. The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such a polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

The transfer layer may also contain from about 2 to about 20 weight percent of a cationic polymer, based on the weight of the thermoplastic polymer. The cationic polymer may be, for example, an amide-epichlorohydrin polymer, polyacrylamides with cationic functional groups, polyethyleneimines, polydiallylamines, and the like. When a cationic polymer is present, a compatible binder should be selected. The binder desirably will be a nonionic binder, either in the form of a solution or a nonionic or cationic dispersion or emulsion. As is well known in the paper coating art, many commercially available binders have anionically charged particles or polymer molecules. These materials are generally not compatible with the cationic polymer which may be used in the present invention.

One or more other components may be used in the transfer layer. For example, the transfer layer may contain from about 1 to about 20 weight percent of a humectant, based on the weight of the thermoplastic polymer. Desirably, the humectant will be selected from the group consisting of ethylene glycol and poly(ethylene glycol). The poly (ethylene glycol) typically will have a weight average molecular weight of from about 100 to about 40,000. A poly(ethylene glycol) having a weight-average molecular weight of from about 200 to about 800 is particularly useful.

The transfer layer also may contain from about 0.2 to about 10 weight percent of a fluid (e.g. ink) viscosity modifier, based on the weight of the thermoplastic polymer. The viscosity modifier desirably will be a poly(ethylene glycol) having a weight-average molecular weight of from about 100,000 to about 2,000,000. The poly(ethylene glycol) desirably will have a weight-average molecular weight of from about 100,000 to about 600,000.

Other components which may be present in the transfer layer include from about 0.1 to about 5 weight percent of a weak acid and from about 0.5 to about 5 weight percent of a surfactant, both based on the weight of the thermoplastic polymer. A particularly useful weak acid is citric acid. The term "weak acid" is used herein to mean an acid having a dissociation constant less than one (or a negative log of the dissociation constant greater than 1).

The surfactant may be an anionic, a nonionic, or a cationic surfactant. When a cationic polymer is present in the transfer layer, the surfactant should not be an anionic surfactant.

Desirably, the surfactant will be a nonionic or cationic surfactant. However, in the absence of the cationic polymer, an anionic surfactant may be used, if desired. Examples of anionic surfactants include, among others, linear and branched-chain sodium alkylbenzenesulfonates, linear and branched-chain alkyl sulfates, and linear and branched-chain alkyl ethoxy sulfates. Cationic surfactant include, by way of illustration, tallow trimethylammonium chloride. Examples of nonionic surfactants, include, again by way of illustration only, alkyl polyethoxylates, polyethoxylated alkylphenols, fatty acid ethanol amides, complex polymers of ethylene oxide, propylene oxide, and alcohols, and polysiloxane polyethers. More desirably, the surfactant will be a nonionic surfactant.

For heat transfer applications, the material of the invention may optionally have a release layer or melt-transfer layer located above the support and below the direct thermal recording layer. Such a melt-transfer film layer typically comprises a film forming binder, as already described, or other polymer. The layer desirably is applied by extrusion coating, but other methods also may be used. The melt-transfer film layer desirably is formed from a polyethylene or a copolymer of ethylene with acrylic acid, methacrylic acid, vinyl acetate, or acrylic acid esters such as ethyl acrylate. The polymer desirably will have a melt flow rate of at least about 30 grams per 10 minutes (g/10 minutes), as determined in accordance with ASTM Method D-1238, although the melt flow rate may be as high as about 4,000 g/10 minutes. More desirably, the melt flow rate of the polymer will be from about 300 to about 700 g/10 minutes. The basis weight of the melt-transfer film layer desirably will be from about 10 to about 50 grams per square meter ($g/m^2$), with a basis weight of from about 30 to about 50 being more desired.

A release layer may be included, either in place of or in addition to the melt-transfer film layer. In the former instance, the release layer will be placed above the support and below the microcapsule containing layer(s). In the latter instance, the release layer will be placed between the support and the melt-transfer film layer. The release layer desirably will be a low molecular weight ethylene-acrylic acid copolymer applied from an aqueous dispersion. The melt flow rate of the ethylene-acrylic acid copolymer desirably will be at least about 200 g/10 minutes, more desirably from about 800 to about 1,200 g/10 minutes. Such dispersion also may contain a paraffin wax, which is mixed as an emulsion with the ethylene-acrylic acid copolymer dispersion. The paraffin wax emulsion can be any of those which are commercially available, such as Chemwax®40 (Chematron, Inc., Charlotte, N.C.). The ratio of paraffin wax to the copolymer may vary from 0 to about 4, with a ratio of about 1 being more desirable. The basis weight of the release layer desirably will be from about 2 to about 20 $g/m^2$, more desirably from about 6 to about 10 $g/m^2$. The release coating as described melts easily and provides easy release from the first layer for hand ironing of images onto a fabric; such characteristic is especially useful if heating of the image is irregular, which is not atypical of hand-ironing techniques.

The various layers of the imaging material are formed by known coating techniques, such as by roll, blade, curtain coating and air-knife coating procedures. The resulting material, then is dried by means of, for example, steam-heated drums, air impingement, radiant heating, or some combination thereof. Some care must be exercised, however, to assure that drying temperatures are sufficiently low so that the particles of thermoplastic polymer present in the tranfer layer do not melt during the drying process.

Heat transfer of an image in the imaging material of the present invention may be by any known means, such as by a hand-held iron or a heat transfer press. The transfer temperature typically will be from about 120° to about 205° Celsius, for from about 5 seconds to about 2 minutes.

Accordingly, the transfer layer of the invention may comprise particles of a thermoplastic polymer preferably having dimensions of from about 1 to about 20 micrometers, and more preferably from about 2 to about 10 micrometers, from about 10 to about 50 weight percent of a film-forming binder, based on the weight of the thermoplastic polymer, and from about 0.2 to about 10 weight percent of a viscosity modifier, based on the weight of the thermoplastic polymer.

The transfer layer preferably has a melting point of more than 100° C. and more preferably from about 100 to about 180 degrees Celsius. The transfer layer may also contain from about 2 to about 20 weight percent of a cationic polymer, based on the weight of the thermoplastic polymer. The transfer layer may also contain from about 1 to about 20 weight percent of a humectant, based on the weight of the thermoplastic polymer The humectant may be (1) ethylene glycol or (2) polyethylene glycol (e.g. having a weight-average molecular weight of from about 100 to about 40,000, preferably about 200 to about 800).

The viscosity modifier may be a polyethylene glycol having a weight average molecular weight of from 100,000 to about 2,000,000, preferably from about 100,000 to about 600,000. The viscosity modifier may be low or high viscosity methyl cellulose or polyvinyl alcohol.

The transfer layer may also include about 0.1 to about 5 weight percent of a weak acid, based on the weight of the thermoplastic polymer. The transfer layer may also include about 0.5 to about 5 weight percent of a surfactant (e.g. nonionic or cationic), based on the weight of the thermoplastic polymer.

A release layer is optionally interposed between the support and the transfer layer of the invention.

The transfer layer preferably melts above 100° C., more preferably, from about 100 to about 180 degrees Celsius and may comprise particles of a thermoplastic polymer having dimensions of about 1 to about 20 micrometers, more preferably from about 2 to about 10 micrometers, from about 10 to about 50 weight percent of a film-forming binder, based on the thermoplastic polymer, and from about 2 to about 20 weight percent of a cationic polymer, based on the weight of the thermoplastic polymer.

The transfer layer may further comprise from about 1 to about 20 weight percent of a humectant, based on the weight of the thermoplastic polymer (and optionally from about 0.2 to about 10 weight percent of a fluid (e.g. ink) viscosity modifier, based on the weight of the thermoplastic polymer), and from 0.5 to about 5 weight percent of a surfactant, based on the weight of the thermoplastic polymer.

The transfer layer of the present invention also utilizes the materials of the image receptive melt-transfer film layer of U.S. Pat. No. 5,271,990.

The transfer layer may be comprised of a thermoplastic polymer which preferably melts at above 100° C., and preferably in the range of from about 100 to about 180 degrees Celsius(° C.). In another embodiment, the thermoplastic polymer melts in the range of from about 100° C. to about 120° C.

The nature of the thermoplastic polymer is not known to be critical, but generally it should be inert (e.g. not adversely affecting the properties relating to the image). That is, any known thermoplastic polymer can be employed so long as it meets the criteria specified herein (e.g., image life of months or years rather than decades). Preferably, the thermoplastic polymer is selected from the group consisting of polyolefins, polyesters, and ethylene-vinyl acetate copolymers, preferably having a particle size of less than about 50 micrometers, preferably less than about 20 micrometers and more preferably between 2 and 10 micrometers.

If desired, as already noted, the imaging material containing the transfer layer of the invention may optionally have a melt-transfer film layer. In this instance, the melt-transfer film layer overlays the top surface of the base sheet and the microcapsule layers overlays the melt transfer film layer.

In general, the melt-transfer film layer is comprised of a first thermoplastic polymer and the microcapsule containing layers are comprised of a second thermoplastic polymer, each of which melts preferably above 100° C., and preferably in the range of from about 100° C. to about 180° C. Preferably, the first thermoplastic polymer is selected from the group consisting of polyolefins, polyesters, ethylene-vinyl acetate copolymers, ethylene-methacrylic acid copolymers, and ethylene-acrylic acid copolymers. In addition, the second thermoplastic polymer preferably is selected from the group consisting of polyolefins, polyesters, and ethylene-vinyl acetate copolymers.

The term "melts" and variations thereof are used herein only in a qualitative sense and are not meant to refer to any particular test procedure. Reference herein to a melting temperature or range is meant only to indicate an approximate temperature or range at which a thermoplastic polymer melts and flows under film forming conditions to result in a substantially smooth film.

The transfer layer may comprise a thermoplastic polymer selected from the group consisting of polyolefins, polyesters, and ethylene-vinyl acetate copolymers and which melts preferably above 100° C., and preferably in the range of from about 100 to about 180 degrees Celsius, and preferably in the range of about 100 to about 120 degrees Celsius.

An example of the transfer layer of the invention is Elvax 3200 supplied by E. I. Du Pont de Nemours & Company, Inc., Polymer Products Department, Ethylene Polymers Division, Wilmington, Del. Elvax 3200 is an ethylene-vinyl acetate copolymer containing approximately 25% vinyl acetate and modified with wax. It has a melt index of 32 g/10 minutes. Another transfer layer of the invention is Surlyn 1702 also supplied by DuPont. Surlyn 1702 is an ionomer consisting of a cross-linked ethylene-methacrylic acid copolymer having a melt index of 14 g/10 minutes. These transfer layers may be utilized separately or together.

The transfer layer of the present invention may also utilize the materials of the image-receptive melt-transfer film layer of U.S. Pat. No. 5,242,739.

The transfer layer may comprise from about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts about 100° C., preferably in the range of from about 100 to about 180 degrees Celsius and said powdered thermoplastic is preferably of particles which are from about 1 to 50 micrometers, preferably from about 1 to about 20 micrometers, in diameter.

Thus, the transfer material comprises from about 15 to about 80 percent by weight of a film-forming binder and from about 85 to about 20 percent by weight of a powdered thermoplastic polymer. Each of the film-forming binder and powdered thermoplastic polymer melts above 100° C., preferably in the range of from about 100 to about 180 degrees Celsius (° C.). In addition, the powdered thermoplastic polymer is preferably composed of particles having diameters of from about 1 to about 20 micrometers, preferably between 2 and 10 micrometers.

In other embodiments, each of the film-forming binder and powdered thermoplastic polymer preferably melt from 50° C. to 180° C., more preferably above 100° C., and most preferably in the range of from about 100° C. to about 120° C.

The function of the powdered thermoplastic polymer is to assist in the transferring of an image to a fabric, both in terms of ease of transfer and the permanence of the transferred image.

The nature of the film-forming binder is not known to be critical. That is, any film-forming binder can be employed so long as it meets the criteria specified herein. In preferred embodiments, the film-forming binder has, at the transfer temperature, a lower melt viscosity than the powdered thermoplastic polymer. As a practical matter, water-dispersible ethylene-acrylic acid copolymers have been found to be especially effective film forming binders.

In general, the powdered thermoplastic polymer can be any thermoplastic polymer which meets the criteria set forth herein. Preferably, the powdered thermoplastic polymer is selected from the group consisting of polyolefins, polyesters, and ethylene-vinyl acetate copolymers.

The powdered thermoplastic polymer flow partially into the fiber matrix of the fabric to which an image is being transferred. The result is a fabric having an image which does not render the fabric stiff. Moreover, the image itself is neither rubbery nor rough to the feel and is stable to repeated washings.

If desired, as already noted, the imaging material containing the transfer layer of the invention may optionally have a melt-transfer film layer. In this instance, the melt-transfer film layer overlays the top surface of the base sheet and the imaging layers overlay the melt-transfer film layer.

The melt-transfer film layer comprises a film-forming binder as already described. The image-receptive film layer preferably comprises from about 15 to about 80 percent by weight of a film-forming binder (e.g. ethylene-acrylic acid copolymers; polyolefins and waxes which melt in the range of about 65 to about 180 degrees Celsius). The melt transfer layer may also contain from about 85 to about 20 percent by weight of a powdered thermoplastic polymer, each of which are as already defined.

As a general rule, the amount of powdered thermoplastic polymer employed can be reduced if larger particle sizes are employed. However, it is believed that the smaller the thermoplastic bead, the better. Particle sizes are preferably from 1–50 micrometers, preferably from 1–20 micrometers and more preferably 2–10 micrometers.

If desired, any of the foregoing film layers can contain other materials, such as processing aids, release agents, deglossing agents, antifoam agents, and the like. The use of these and other like materials is well known to those having ordinary skill in the art.

Representative binders and powdered thermoplastic polymers are as follows:

Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pa s (650 centipoise) at 140° C.

Binder B

This binder is Michem® Prime 4983 (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder F is Michem® 48040, an emulsion of an Eastman Chemical Company microcrystalline wax having a melting point of 88° C. The supplier is Michelman, Inc., Cincinnati, Ohio.

Powdered Thermoplastic Polymer A

This powdered polymer is Microthene® FE 532, an ethylenevinyl acetate copolymer supplied by Quantum Industries, Cincinnati, Ohio. The particle size is reported to be 20 micrometers. The vicat softening point is 75° C. and the melt index is 9 g/10 minutes.

Powdered Thermoplastic Polymer B

Powdered Thermoplastic Polymer B is Aqua Polysilk 19. It is a micronized polyethylene wax containing some polytetrafluoroethylene. The average particle size is 18 micrometers and the melting point of the polymer is 102°–118° C. The material is supplied by Micro Powders, Inc., Scarsdale, N.Y.

Powdered Thermoplastic Polymer C

This material is Microthene® FN-500, a polyethylene powder supplied by USI Chemicals Co., Cincinnati, Ohio. The material has a particle size of 20 micrometers, a Vicat softening point of 83° C., and a melt index of 22 g/10 minutes.

Powdered Thermoplastic Polymer D

This polymer is Aquawax 114, supplied by Micro Powders, Inc., Scarsdale, N.Y. The polymer has a reported melting point of 91°–93° C. and an average particle size of 3.5 micrometers; the maximum particle size is stated to be 13 micrometers.

Powdered Thermoplastic Polymer E

Powdered Thermoplastic Polymer E is Corvel® 23-9030, a clear polyester from the Powder Coatings Group of the Morton Chemical Division, Morton Thiokol, Inc., Reading, Pa.

Powdered Thermoplastic Polymer F

This material is Corvel® natural nylon 20–9001, also supplied by Morton Thiokol, Inc.

Powdered Thermoplastic Polymer G

This polymer powder is Corvel® clear epoxy 13-9020, supplied by Morton Thiokol, Inc.

Powdered Thermoplastic Polymer H

Powdered Thermoplastic Polymer H is AClyn® 246A, which has a melting temperature of about 95° C. as determined by differential scanning calorimetry. The polymer is an ethylene-acrylic acid magnesium ionomer. The material is supplied by Allied-Signal, Inc., Morristown, N.J.

Powdered Thermoplastic Polymer I

This polymer is AC-316A, an oxidized high density polyethylene. The material is supplied by Allied Chemical Company, Morristown, N.J.

Powdered Thermoplastic Polymer J

This polymer is Texture 5380, supplied by Shamrock Technologies, Inc., Newark, N.J. It is powdered polypropylene having a melting point of 165° C. and an average particle size of 40 micrometers.

The binders and thermoplastic polymers may be combined and blended as desired. For example, Binder A (e.g. 80 parts) may be blended with powdered thermoplastic polymer A (e.g. 80 parts) and optionally with a fluorocarbon dispersion such as Zonyl 7040 (e.g. 0.20 parts) obtained from Du Pont. Another example includes combining Binder B (e.g. 400 parts) and Polymer B (e.g. 70 parts) and blending in a standard laboratory colloid mill. Also, Binder A (e.g. 286 parts) may be combined with Polymer C (e.g. 65 parts). Binder B (e.g. 400 parts) may be combined with Polymer D (e.g. 70 parts). Binder C (e.g. 200 parts) may be combined with Polymer E (e.g. 35 parts) and optionally with propylene glycol (e.g. 20 parts) and water (e.g. 20 parts). Similarly, Binder C (e.g. 200 parts) may be combined with Polymer F (e.g. 54 parts) and optionally with propylene glycol (e.g. 20 parts) and water (e.g. 20 parts). Also, Binder A (e.g. 200 parts) may be combined with Polymer G (e.g. 30 parts) and optionally with propylene glycol (e.g. 20 parts) and water (e.g. 20 parts). Binder D (e.g. 200 parts) may be combined with Polymer H (e.g. 30 parts) and optionally water (e.g. 40 parts) and blended. Binder A (e.g. 286 parts) may be combined with Polymer J (e.g. 40 parts) and optionally with propylene glycol (e.g. 50 parts).

The transfer layer is present in sufficient quantity so as to provide a colorfast image when transferred to the receptor surface and to provide for the desired transfer. More specifically, the transfer layer of the invention may be preferably present in an amount of at least 50% by coating weight based on the total weight of the layers present in the imaging element (excluding support).

Therefore, if two layers are present, the transfer layer may be present in an amount of 50% by weight based on the total weight of the two layers. If three layers are present, the transfer layer may be present in an amount of 50% by weight based on the total weight of the three layers, and so on.

In an alternative embodiment of the present invention, the cold-peel transfer system of U.S. Pat. No. 5,798,179 is used. In this embodiment, the at least one thermal recording layer containing heat-responsive microcapsules capable of creating an image is coated over the third layer (i.e. which overcoats the second layer), which layers are disclosed in U.S. Pat. No. 5,798,179.

The microcapsules according to the present invention can be prepared as detailed in U.S. Pat. No. 5,492,789, however, these procedures are merely illustrating and are not to be considered as limiting.

The recording material of the present invention is prepared by coating a support, such as paper, with a coating of the transfer material according to the present invention. Next, on top of the transfer material is coated a composition containing the microcapsules. The coating procedure according to the present invention may be accomplished by bar coating, blade coating, air knife coating, gravure coating, roll coating, spray coating, dip coating, curtain coating and the like. Following each coating procedure, each layer is dried.

A representative, but not limiting means for recording on the thermal recording material of the present invention is carried out as follows. The recording material is imagewise heated with a thermal head, etc. to soften the capsule wall whereby the coupler and the organic base outside the capsules enter the inside of the capsules to develop a color. After the color development, the recording layer is exposed to light having the absorption wavelength of the diazonium salt whereby the diazonium salt decomposes and loses its reactivity with the coupler. As a result, the image is fixed.

Light sources for image fixation include various fluorescent lamps, xenon lamps, and mercury lamps. It is desirable for efficient fixation that the emission spectrum of the light source substantially meets the absorption spectrum of the diazo compound used.

A representative imaging sheet of the invention may be formed as follows. A support is coated with the transfer layer according to the present invention. The transfer layer is then dried. Next, on top of the transfer layer is coated a composition containing the microcapsules. A representative formulation of the layer containing the microcapsules is described in any one of Examples 3, 22, and 26 of U.S. Pat. No. 5,661,101, and Examples 5 and 10 of U.S. Pat. No. 5,543,260. The microcapsule layer is then dried.

The coating procedure according to the present invention may be accomplished by bar coating, blade coating, air knife coating, gravure coating, roll coating, spray coating, dip coating, curtain coating and the like.

Referring to FIG. 1, there is generally illustrated a cross-sectional view of the imaging sheet for transferring a light-fixable thermal imaging element of the present invention 10. The element 10 includes a support 12 having a transfer coating layer 120 and a light-fixable thermal imaging layer 14 on one surface thereof. The layer 14 includes thermal sensitive microcapsules 16 and an outer phase material 18, comprising a suitable carrier for the microcapsules, such as gelatin. The support 12 may be a polymeric film. If the support 12 is transparent, the imaging sheet can be exposed from either surface. The microcapsules 16 contain an inner phase 22, comprising a element capable of generating a color when reacted with elements contained in the outer phase 18.

Figure 2:
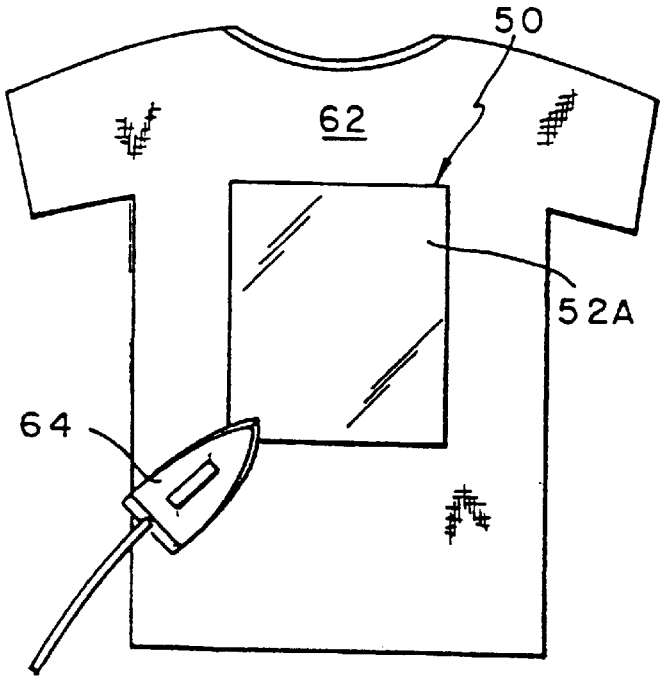

Referring to FIG. 2, techniques for utilizing the imaging sheet 10 are known in the art (for example, refer to FIG. 2 of U.S. Pat. 4,751,165 and the explanations therein).

A suitable support or substrate which may be any type of material ordinarily used as a support for imaging materials. Examples thereof include cellulose acetate films, cellulose acetate propionate films, cellulose nitrate films, cellulose acetate butyrate films, polyethylene terephthalate films, polystyrene films, polycarbonate films, and laminated sheets of these films and papers. Suitable papers include papers coated with a polymer of an alpha olefin and preferably an alpha olefin having 2 to 10 carbon atoms, such as polyethylene, polypropylene, etc., and baryta coated papers, etc. The only limitation on the support is that it must separate from the transfer layer upon application of heat. If conventional polyolefin paper interferes with transfer due to poor separation from the transfer layer, fiber based paper which does not contain a resin coated layer nearest the support layer or on both surfaces is preferably used.

An imaging support or substrate may be coated with the desired microcapsules in a conventional manner by methods known to one of ordinary skill in the art.

Accordingly, the present invention relates to an imaging system, which comprises:

a support having a front and rear surface;

at least one transfer layer of the invention interposed between said front surface of the support and at least one (i.e., light-fixable) thermal recording layer, wherein said at least one transfer layer is capable of transferring and adhering an image from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external adhesive layer, with the proviso that the transfer layer is not capable of reacting to form an image; and at least one (i.e., light-fixable) thermal recording layer comprising heat-responsive microcapsules capable of separating an inner phase within said microcapsules from an outer phase contained outside said microcapsules, on said front surface of the at least one transfer layer, wherein said inner phase is capable of reacting with said outer phase to create a color forming element.

In the imaging system explained above, the heat-responsive microcapsules have discrete capsular walls capable of isolating said inner phase from said outer phase, wherein said inner phase comprises a diazonium salt compound and said outer phase comprises a coupler a reaction-accelerating organic base, and an appropriate carrier, such as gelatin.

The imaging system according to the present invention optionally further comprises a protective layer of clear thermoplastic.

In another embodiment of the present invention, the imaging system explained above comprises an imaging sheet useful in forming images by temperature controlled exposure of a said inner phase with said outer phase, said sheet comprising:

a support having a front and rear surface;

a transfer layer of the invention coated on said front surface of said support; and a layer of microcapsules coated on top of said transfer layer, said microcapsules having discrete capsule walls which encapsulate said internal phase, said internal phase, including a diazonium salt compound, said outer phase comprising a coupler which upon an increase in temperature of said capsular wall diffuses into said microcapsule and reacts with said inner phase to form a color forming element.

According to the imaging system of the present invention said thermal recording layer comprises three separate layers, wherein each layer is capable of generating a color selected from the group consisting of yellow, cyan and magenta, with the proviso that each layer must generate a different color. Said colors are generated in response to heat. Specifically, said yellow color is generated in response to a thermal energy level which is lower than the thermal energy level sufficient to generate said cyan color. Additionally, said magenta color is generated in response to a thermal energy level which is lower than the thermal energy level sufficient to generate said cyan color and which is higher than the thermal energy level sufficient to generate said yellow color.

The yellow and cyan colors are fixed by exposure to ultraviolet radiation. Specifically, the yellow color is fixed in response to radiation having a 420 nm wavelength and the cyan color is fixed in response to radiation having a 365 nm wavelength.

The imaging system of the present invention also relates to an imaging sheet useful in forming images onto a receptor surface, said sheet comprising:

a support having a front and rear surface;

a transfer layer of the invention coated on said front surface of said support; and a layer of microcapsules coated on top of said transfer layer, said microcapsules having discrete capsule walls which encapsulate said internal phase, said internal phase, including a diazonium salt compound, said outer phase comprising a coupler which upon an increase in temperature of said capsular wall diffuses into said microcapsule and reacts with said inner phase to form a dye.

One preferred application of this invention is directed to transfer elements capable of producing multicolor dye images. Such a transfer element comprises a support and a plurality of color forming layers coated thereon. The color forming layers include at least one blue recording yellow dye image forming layer, at least one green recording magenta dye image forming layer, and at least one red recording cyan dye image forming layer. Interlayers may be positioned between the color forming layers. Each image forming layer includes at least one microcapsule layer. The interlayers may contain 100% carrier of the invention, or may contain conventional materials, or a combination thereof.

Accordingly, the present invention is directed to an imaging system, which comprises a support having a front and rear surface;

a transfer layer of the invention;

a direct thermal recording layer;

and an optional layer of clear thermoplastic material.

The transfer layer of the present invention is applicable to any imaging system based on thermal sensitive microencapsulates. Said system comprises a support;

at least one transfer layer coated on top of said support, said transfer layer preferably having a melting point of approximately 100° C. to 180° C., and which is capable of transferring and adhering an image from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external (e.g. surface) adhesive layer; and at least one layer of microcapsules coated on top of the outermost transfer layer, wherein said microcapsules are separated from said support by said transfer layer; and an optional layer of clear thermoplastic material, wherein the adherence of the transfer layer to the receptor element preferably occurs in an area at least coextensive with the area of said microcapsules, with the proviso that the transfer layer is not capable of reacting (e.g. with a color precursor) to form an image.

Preferably, the particle size of the transfer layer is the same or smaller than that of the microcapsules, for example, from about 1–50 micrometers, preferably from 1–20 micrometers. This particle size is more preferably not greater than 10 micrometers.

Another embodiment of the present invention is directed to an imaging sheet useful in forming images onto a receptor surface, said sheet comprising:

a support having a front and rear surface;

a transfer layer on said front surface of said support; and a plurality of direct thermal recording microcapsule layer (s), said layer(s) being situated on top of the transfer layer of the invention.

The present invention further relates of a method of transferring an image to a receptor element, which comprises the steps of:

(a) forming the direct thermal recording image described above, said image being formed on a front surface of a support having a front and a back surface;

(b) positioning the front surface of said image against said receptor element, said image being separated from said support by a layer comprising a transfer layer according to the present invention;

(c) applying heat to the rear surface of the support to transfer the image to the receptor element.

Thus, the present invention is directed to an imaging material comprising a support having a front and rear surface;

a transfer layer of the invention on one surface of said support;

and a direct thermal recording layer coated on top of the transfer layer of the present invention.

The invention is illustrated in more detail by the following non-limiting examples:

EXAMPLE 1

A thermal image transfer element is prepared as follows: The light-fixable thermal recording layer according to Example 2 of U.S. Pat. No. 4,771,032 is coated by wire bar coating onto the coated base sheet of Example 1 of U.S. Pat. No. 5,501,902 at a coverage of 25 ml/m$^2$, followed by air-drying. The recording material is then subjected to the procedure described in the thermal recording Samples of U.S. Pat. No. 5,486,446 as follows.

Applied power to thermal head and pulse duration are set so that the recording energy per area is 35 mJ/mm$^2$. The writing (I) of the heat-sensitive recording material is conducted using Thermal head (KST type, a product of Kyocera K.K.)

Subsequently, the recording material is exposed to an ultraviolet lamp (light emitting central wavelength: 420 nm; output 40 W) for 10 seconds. Applied power to the thermal head and pulse duration are again set so that the recording energy per unit area is 62 mJ/mm$^2$, and writing (III) of the heat-sensitive recording material is conducted under these temperatures.

Furthermore, the recording material is exposed to an ultraviolet lamp (light emitting central wavelength: 365 nm; output: 40 W) for 15 seconds. Applied power to the thermal head and pulse duration are again set so that the recording energy per unit area is 86 mJ/mm$^2$, and writing (III) of the heat-sensitive recording material is conducted under these conditions.

Next, referring to FIG. 2, the method of applying the image to a receptor element will be described.

The imaging sheet 50 is prepared, exposed and developed to form an image as described above. A receptor element (e.g., tee shirt 62) is laid flat as illustrated, on an appropriate support surface, and the front surface of the imaging sheet 50 is positioned on the tee shirt. An iron 64 is run and pressed across the back 52A of the imaging sheet. The image and non-image areas are transferred to the tee-shirt and the support is removed and discarded.

EXAMPLES 2–6

Example 1 is repeated but this time the thermal recording layer according to Example 2 of U.S. Pat. No. 4,771,032 is substituted with other thermal recording layers as follows:

| Example Number | Source of thermal recording layer |
|---|---|
| 2 | Ex. 5 of U.S. Pat. No. 5,543,260 |
| 3 | Ex. 10 of U.S. Pat. No. 5,543,260 |
| 4 | Ex. 3 of U.S. Pat. No. 5,661,101 |
| 5 | Ex. 22 of U.S. Pat. No. 5,661,101 |
| 6 | Ex. 26 of U.S. Pat. No. 5,661,101 |

EXAMPLE 7

A paper support which is not coated on both sides with polyethylene is coated with a melt-transfer layer consisting of a mixture of Michem® 58035R and Michem® Prime 4983R. Both materials are available from Michelman, Inc., Cincinnati, Ohio. A ratio of four or five to one of 58035R to 4983R is used. The basis weight of the melt-transfer layer is 8 g/m$^2$. Michem 58035R is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 Pas (650 centipoise) at 140° C. Michem® Prime 4983R is a 25 percent solids dispersion of Primacor® 5985 made by Dow Chemical Company. The polymer contains 20 percent acrylic acid and 80 percent ethylene. The copolymer has a Vicat softening point of 43° C. and a ring and ball softening point of 108° C. The melt flow rate of the copolymer is 500 g/10 minutes.

When the thermoplastic binder and/or the binder are the variables, the cationic polymer in every case is an amide-epichlorohydrin copolymer, namely, either Kymene® 557H or Retens® 204LS, both being supplied by Hercules Inc., Wilmington, Del. The cationic polymer is included at a level of 5 weight percent, based on the weight of the thermoplastic polymer. The transfer layer is dried by heating at 80°–95° C. The basis weight of the transfer layer is 15 g/m$^2$.

In general, a minimum amount of binder is used. For example, 10 weight percent of a polyacrylate, Rhoplex® B-15J (Rohm and Haas Company) may be used. Another binder which may be used at the 10 weight percent level is Michem® 58035, described above. The binder must be compatible with the cationic polymer. Two binders which are more compatible with the cationic polymer and which yellow less than the Michem® 58035 are Airflex® 124 and Airflex® 125, both poly(vinyl alcohol) stabilized ethylene-vinyl acetate copolymers. The materials are available from Air Products and Chemicals, Inc., Allentown, Pa.

Several thermoplastic polymers may be used including Microthene® FE 532, an ethylene-vinyl acetate copolymer supplied by Millenium Chemical Incorp., Cincinnati, Ohio. The particle size is reported to average approximately 20 micrometers. The Vicat softening point is 75° C. The melt flow rate of the copolymer is 9 g/10 minutes and it is reported to have a density of 0.928 g/cm$^3$. Another thermoplastic polymer is Microthene® FN 500, a low density polyethylene powder also supplied by USI Chemicals Co. The material has an average particle size of 20 micrometers, a Vicat softening point of 83° C., a melt flow rate of 22 g/10 minutes, and a density of 0.915 g/cm$^3$.

EXAMPLES 8–13

The transfer layer according to Example 7 is coated with thermal recording layers as follows:

| Example Number | Source of thermal recording layer |
|---|---|
| 8 | Ex. 2 of U.S. Pat. No. 4,771,032 |
| 9 | Ex. 5 of U.S. Pat. No. 5,543,260 |
| 10 | Ex. 10 of U.S. Pat. No. 5,543,260 |
| 11 | Ex. 3 of U.S. Pat. No. 5,661,101 |
| 12 | Ex. 22 of U.S. Pat. No. 5,661,101 |
| 13 | Ex. 26 of U.S. Pat. No. 5,661,101 |

The material is exposed, fixed and transferred as in Example 1.

EXAMPLE 14

Examples 8–13 are repeated, but using the following thermoplastic polymers and Binders:

Thermoplastic Polymer A

This polymer is Microthene® FE 532, described in Example 15.

Thermoplastic Polymer B

This material is Microthene® FN-500, also described in Example 15.

Thermoplastic Polymer C

Thermoplastic Polymer C is Corvel® 2093. It is a polyester. The average particle size is 20 micrometers, the melting point of the polymer is approximately 80° C., and the melt flow rate is reported to be "high". The material is supplied by Powder Coatings Group of the Morton Chemical Division, Morton Thiokol, Inc., Reading, Pa.

Thermoplastic Polymer D

This polymer is MP 22, described in Example 15.

Thermoplastic Polymer E

Thermoplastic Polymer E is MPP 611, also described in Example 15.

Thermoplastic Polymer F

This material is MPP 635, also a polyethylene supplied by Micro Powders, Inc. The average particle size of the polymer is 5 micrometers, the melting point is reported to be 124, and the melt flow rate is "high".

Thermoplastic Polymer G

This polymer is Accumist® B6, supplied by Allied Chemical Company, Morristown, N.J. The polymer is a polyethylene having a melting point of 126° C. The average particle size of the polymer is 6 micrometers and the melt flow rate is "high".

Thermoplastic Polymer H

Thermoplastic Polymer H is Accumist® B12, also supplied by Allied Chemical Company. The polymer is a high density polyethylene having a melting point of 126° C. The average particle size of the polymer is 12 micrometers.

Thermoplastic Polymer I

This polymer is DPP 714, a polystyrene dispersion supplied by Dow Chemical Company, Midland, Mich.

Thermoplastic Polymer J

This material is Piccotex® LC55R, a styrene-methyl styrene copolymer dispersion supplied by Hercules, Inc.

Thermoplastic K

Thermoplastic Polymer K is DL 256, a polystyrene dispersion also supplied by Dow Chemical Company.

Thermoplastic L

This polymer is BN 4901X, a polystyrene dispersion available from BASF Corporation, Sarnia, Ontario, Canada.

Thermoplastic M

This material is Ropaque®, a polystyrene dispersion supplied by Rohm and Haas Company, Philadelphia, Pa.

Four different binders are used:

Binder A

Binder A is Carboset® 514H, a polyacrylate binder dispersed in water, supplied by B.F. Goodrich Company, Cleveland, Ohio.

Binder B

This binder is Rhoplex® B15, described in Example 15.

Binder C

Binder C is Michem® 58035, also described in Example 15.

Binder D

This binder is Marklube® 542, a cationic low density polyethylene emulsion from Ivax Industries, Inc., Rock Hill, S.C.

The composition of the transfer layer is summarized in Table 1 below. In the Table, the "TP" column identifies the thermoplastic polymer by letter, the "Type" column identifies the binder by letter, and basis weights are given in g/m$^2$.

TABLE 1

Summary of Tranfer layer Composition with Various Thermoplastic Polymers

| | Binder | | Basis |
|---|---|---|---|
| TP | Type | Wt. % | Weight |
| A | A | 10 | 21 |
| A | B | 10 | 23 |
| A | C | 10 | 23 |
| A | C | 20 | 23 |
| B | C | 50 | 31 |
| B | C | 10 | 23 |
| C | C | 10 | 32 |
| D | C | 10 | 30 |
| E | C | 10 | 23 |
| E | C | 12.5 | 28 |
| E | C | 12.5 | 8 |
| E | C | 12.5 | 13 |
| F | C | 10 | 23 |
| F | C | 12.5 | 13 |
| F | C | 18 | 11 |
| F | C | 20 | 13 |
| F | D | 25 | 13 |
| G | C | 18 | 13 |
| H | C | 18 | 13 |
| I | C | 10 | 17 |
| J | C | 10 | 17 |
| K | C | 10 | 8 |
| L | C | 10 | 8 |
| M | C | 10 | 8 |
| M | C | 30 | 8 |
| M | C | 40 | 8 |

EXAMPLE 15

Example 14 is repeated without the melt-transfer layer.

EXAMPLE 16

A base sheet of fiber based paper which is not coated with polyethylene on both sides is coated with a low molecular weight polymer film layer, referred to hereinafter as the first layer. The next layer is a film based on a polymer having a higher molecular weight, referred to hereinafter as the second layer. Finally, the transfer layer (on top of the second layer) consists mainly of low molecular weight polyethylene wax particles, with the layer of any one of Examples 8–13 coated thereon.

A number of multi layered samples (including the base sheet) are evaluated. In every case, the transfer layer material consisted of 77 weight percent MPP 635 (Thermoplastic Polymer F), 8 weight percent of BN 4901X (Thermoplastic Polymer L), 10 weight percent Michem® 58035 (Binder C), 4 weight percent Reten® 204LS (cationic polymer), and 1 weight percent Triton® , X-100, a surfactant, all based on the total weight of the layer. These weights of binder, cationic polymer, and surfactant are equivalent to 12, 5 and 1 weight percent, respectively, based on the weight of thermoplastic polymer.

A preferred sample using this format contains the following:

First layer: The layer consists of 45 weight percent Michem® 4983 and 55 weight percent Chemawax® 40. The layer is applied as a mixed latex. The basis weight of the layer is 8 g/m$^2$.

Second layer: The layer, located adjacent to the paper, consists of Epolene® C13 which is formed by melt extrusion at a basis weight of 20 g/m$^2$. The polymer is a 200 melt flow rate low density polyethylene obtained from Eastman Chemical Products, Inc., Kingsport, Tenn.

Another material which may be used as the second layer and which can be extrusion coated on the paper base sheet is Nucrel® RX 62, supplied by E.I. Du Pont de Nemours and Company, Inc., Wilmington, Del. The polymer is an ethylene-methacrylic acid copolymer having 10 weight percent methacrylic acid and a melt flow rate of around 500 g/10 min.

The material is exposed, fixed and transferred as in Example 1.

EXAMPLE 17

This Example evaluates various cationic polymers. Two types of transfer layers are employed, in which the cationic polymer is included as a component. Type A consists of Microthene® FE 532 (Thermoplastic Polymer A), 13 weight percent of Michem® 58035 binder (Binder C), based on the weight of the thermoplastic polymer, 1 weight percent Tritong X-100 surfactant, and the cationic polymer. The basis weight of the layer is 15 g/m$^2$. The Type B layer consists of MPP 635 (Thermoplastic Polymer F), 18 weight percent of Michem® 58035 binder (Binder C), based on the weight of the thermoplastic polymer, 1 weight percent Triton® X-100 surfactant, and the cationic polymer. The basis weight of the layer was 13 g/m$^2$. When The Type B second layer is employed, a third layer consisting of Michem® 58035 at a basis weight of 17 g/m$^2$ is employed, adjacent to the paper support. The various cationic polymers evaluated are as follows:

Cationic Polymer A

Cationic Polymer A is Kymene® 557, an amide-epichlorohydrin copolymer available from Hercules, Inc.

Cationic Polymer B

This polymer is Calgan® 261LV, a quaternary polymer. It is available from Calgon Corporation.

Cationic Polymer C

This material is Corcat® P145. It is a polyethyleneimine supplied by Cordova Chemical Company.

Cationic Polymer D

Cationic Polymer D is Parez® 631NC, a polyacrylamide available from American Cyanamide.

Cationic Polymer E

This material is Betz® 1260. It is obtained from Betz Paperchem, Trevose, Pa.

Cationic Polymer F

This polymer is Retens 204LS, an amide-epichlorohydrin copolymer available from Hercules, Inc.

Cationic Polymer G

Verona ® C-300 from Miles Inc., Pittsburgh, Pa.

Cationic Polymer H

Aquaprox® UP103 from Synthron, Morgantown, N.C.

Cationic Polymer I

Tinofix® EW from Ciba-Geigy Corporation, Hawthorn, N.Y.

Cationic Polymer J

Reactofix® ES from Ivax Industries, Inc.

Cationic Polymer K

Protefix® TS, a cationic carbamide from Synthron.

In the table, the column "CP" Type"identifies the cationic polymer, whereas the column "Type" identifies the type of transfer material employed, as described above.

TABLE 4

Evaluation of Various Cationic Polymers

| CP Type | Amount | Type |
|---|---|---|
| A | 2 | A |
| A | 4 | A |
| A | 6 | A |
| B | 2 | A |
| B | 4 | A |
| C | 2 | A |
| C | 4 | A |
| D | 2 | A |
| D | 4 | A |
| E | 2 | A |
| F | 5 | A |
| F | 4 | A |
| F | 8 | A |
| G | 8 | B |
| H | 8 | B |
| I | 8 | B |
| J | 8 | B |
| K | 8 | B |

The imaging layer as described in any one of Examples 8–13 is coated onto the transfer layer, which is coated on (i) a fiber base paper which is not coated on both sides with polyethylene and (ii) transparent polyacetate film. The material is exposed, fixed and transferred as described in Example 1.

EXAMPLE 18

The formulations involving Cationic Polymer F as reported in Example 17 are modified further since yellowing may be encountered when images are heat transferred.

In the experiments, the paper base which is not coated on both sides with polyethylene is extrusion coated with 44 g/m$^2$ of Nucrel® RX62, an ethylene-methacrylic acid copolymer having a melt flow rate of 600 g/10 minutes supplied by E. I. Du Pont de Nemours and Co., Inc. The second layer had a basis weight of approximately 13 g/m$^2$.

The binder employed in the transfer layer (e.g. containing microcapsules as described in any one of Examples 8–13) is either Airflex® 124 (Binder E) or Airflex 125® (Binder F). The binder is present at a level of 26 weight percent, based on the weight of the thermoplastic polymer. The cationic polymer used is Reten® 204LS, the humectant is Polyglycol® E200, a poly(ethylene glycol) from Dow Chemical Company having a weight-average molecular weight of about 200; the humectant level is 10 weight percent, based on the weight of the thermoplastic polymer. The surfactant is Triton® X-100 at a level of 3 weight percent, based on the weight of thermoplastic polymer employed. The fluid viscosity modifier is Polyox® N80 at a level of 3 weight percent, also based on the weight of the thermoplastic polymer. The thermoplastic polymers evaluated included micropowders MPP 635 and Accumist® A-12, from Micropowders and Allied Chemical Company, respectively. The material is exposed, fixed and transferred as described in Example 1.

The experiments are summarized in Table 5. In the table, the "TP" column identifies the thermoplastic polymer by letter (see Example 5), the "WT. -%. CP" column identifies the amount of Reten® 204LS employed in the second layer in weight percent, based on the weight of the thermoplastic polymer, and the "WT. -% Acid" column identifies the amount of citric acid included in the transfer layer, in weight-percent based on the weight of the thermoplastic polymer.

TABLE 5

| | Summary of Cationic Polymer F Formulation Modifications | | | |
|---|---|---|---|---|
| Sample | Binder | TP | Parts CP | Wt.-% Acid |
| 1 | F | H | 8 | None |
| 2 | F | H | 8 | 4 |
| 3 | E | H | 8 | None |
| 4 | F | F | 8 | None |
| 5 | F | F | 12 | None |
| 6 | F | F | 16 | None |

EXAMPLE 19

A transfer element of the present invention is prepared as described in Example 1 above, except that the thermal recording layer is coated onto any of the inventive supports disclosed in the Examples of U.S. Pat. No. 5,798,179.

The coated sheet is then imaged and developed as in Example 1 above.

The transfer steps described in U.S. Pat. No. 5,798,179 are then followed

All cited patents; publications, copending applications and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An imaging system, which comprises:

(a) support having a front and a rear surface;

(b) a transfer layer on said front surface of the support, wherein said transfer layer comprises at least one of:

(i) particles of a thermoplastic polymer having dimensions of about 1 to about 50 micrometers, from about 10 to about 50 weight percent of a film-forming binder, based on the weight of the thermoplastic polymer, and optionally from about 0.2 to about 10 weight percent of a fluid viscosity modifer, based on the weight of the thermoplastic polymer, (ii) about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts in the range of from about 100 to about 180° C. and particles of about 1 to about 50 micrometers, (iii) a film forming binder selected from the group consisting of ethylene-acrylic acid copolymers having particles of about 1 to about 50 micrometers, polyolefins, and waxes and which melt in the range of from about 100 to about 180° C., (iv) a thermoplastic polymer having particles of about 1 to about 50 micrometers selected from the group consisting of polyolefins, polyesters, and ethylene-vinyl acetate copolymers and which melts in the range of from about 100 to about 180° C. or, (v) a thermoplastic polymer having particles of about 1 to about 50 micrometers selected from the group consisting of polyolefins, polyesters, and ethylene-vinyl acetate copolymers, ethylene-methacrylic acid copolymers, and ethylene-acrylic acid copolymers and which melts in the range of from about 100 to about 180° C., wherein said transfer layer is capable of transferring and adhering an image from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external adhesive layer, with the proviso that the transfer layer is inert and is not capable of reacting to form an image and acts only as release and adherence layer and does not contain image forming components comprising developer; and (c) at least one thermal recording layer coated on the surface of the at least one transfer layer, wherein said at least one thermal recording layer contains heat-responsive microcapsules capable of creating an image.

2. An imaging system according to claim 1, wherein said heat-responsive microcapsules are capable of separating an inner phase within said microcapsules from an outer phase contained outside said microcapsules, wherein said inner phase is capable of reacting with said outer phase to create colors which make up said image.

3. An imaging system according to claim 2, wherein said heat-responsive microcapsules have discrete capsular walls capable of isolating said inner phase from said outer phase.

4. An imaging system according to claim 2, wherein said inner phase comprises a diazonium salt compound.

5. An imaging system according to claim 2, wherein said outer phase comprises a coupler.

6. An imaging system according to claim 5, wherein said outer phase further comprises a reaction-accelerating organic base.

7. The imaging system of claim 2, which comprises an imaging sheet useful in forming images by temperature controlled exposure of a said inner phase with said outer phase, said sheet comprising:

said support having said front and rear surfaces;

said transfer layer;

a layer of microcapsules, said microcapsules having discrete capsule walls which encapsulate said internal phase, said internal phase, including a diazonium salt compound, said outer phase comprising a coupler which upon an increase in temperature of said capsular wall diffuses into said microcapsule and reacts with said inner phase to form a color forming element.

8. An imaging system according to claim 2, which comprises an imaging sheet useful in forming images onto a receptor surface, said sheet comprising:

said support having said front and rear surfaces;

said transfer layer;

a layer of microcapsules, said microcapsules having discrete capsule walls which encapsulate said internal phase, said internal phase, including a diazonium salt compound, said outer phase comprising a coupler which upon an increase in temperature of said capsular wall diffuses into said microcapsule and reacts with said inner phase to form a dye.

9. The imaging system of claim 1, wherein the transfer layer comprises particles of a thermoplastic polymer having dimensions of about 1 to about 50 micrometers, from about 10 to about 50 weight percent of a film-forming binder, based on the weight of the thermoplastic polymer, and from about 0.2 to about 10 weight percent of an viscosity modifier, based on the weight of the thermoplastic polymer.

10. The imaging system of claim 1, wherein the transfer layer melts from about 100 to about 180° C. and comprises particles of a thermoplastic polymer having dimensions of about 1 to about 50 micrometers in diameter, from about 10 to about 50 weight percent of a film-forming binder, based on the weight of the thermoplastic polymer, and from about 2 to about 20 weight percent of a cationic polymer, based on the weight of the thermoplastic polymer.

11. The imaging system of claim 1, wherein the transfer layer comprises from about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts in the range of from about 100 to about 180° C. and said powdered thermoplastic consists of particles which are from about 1 to about 50 micrometers in diameter.

12. The imaging system of claim 1, wherein the transfer layer comprises a film forming binder selected from the group consisting of ethylene-acrylic acid copolymers, polyolefins, and waxes and which melts in the range of from about 100 to about 180° C.

13. The imaging system of claim 1, wherein the transfer layer comprises a thermoplastic polymer selected from the group consisting of polyolefins, polyesters, and ethylene-vinyl acetate copolymers and which melts in the range of from about 100 to about 180° C.

14. The imaging system of claim 1, wherein the transfer layer comprises a thermoplastic polymer selected from the group consisting of polyolefins, polyesters, and ethylene-vinyl acetate copolymers, ethylene-methacrylic acid copolymers, and ethylene-acrylic acid copolymers and which melts in the range of from about 100 to about 180° C.

15. The imaging system of claim 1, wherein said layer of microcapsules contains three separate layers of microcapsules sensitive, said separate layers of microcapsules contain cyan, magenta and yellow image-forming agents, respectively.

16. The imaging system of claim 1, wherein the microcapsules contain a diazonium salt compound as a color forming material, and the layer containing the microcapsules further comprises a coupler and a reaction-accelerating organic base.

17. A method of transferring an image to a receptor element which comprises the steps of:

(a) forming said image on the imaging system of claim 1, (b) positioning the front surface of said image against said receptor element, said image being separated from said support by a layer comprising a transfer material according to the present invention, (c) applying heat to the rear surface of the support to transfer the image to the receptor element.

18. A method according to claim 17, wherein the receptor element is textile, leather, ceramic or wool.

19. A method according to claim 17, wherein the receptor element is a shirt or the like.

20. An imaging system according to claim 1, wherein said at least one thermal recording layer comprises at least a first and a second color forming layers, said first color forming layer being capable of generating a yellow color, and said second color forming layer being capable of generating a cyan color.

21. An imaging system according to claim 20, further comprising a third color forming layer capable of generating a magenta color.

22. An imaging system according to claim 20, wherein said yellow color is generated in response to a thermal energy level which is lower than the thermal energy level sufficient to generate said cyan color.

23. An imaging system, which comprises:

a first support layer having a front and a rear surface;

a second layer overlaying the front surface of the first support layer, which second layer comprises a thermoplastic polymer having essentially no tack at transfer temperatures of about 177 degrees Celsius, a solubility parameter of at least about 19 (Mpa)½, and a glass transition temperature of at least about 0° C.; and a third layer overlaying the second layer, which third layer comprises a thermoplastic polymer which melts in a range of from about 65° C. to about 180° C. and has a solubility parameter less than about 19 (Mpa)½;

wherein the second and third layers provide the imaging system with cold release properties; and at least one thermal recording layer coated on the surface of the third layer, wherein said at least one thermal recording layer contains heat-responsive microcapsules capable of creating an image.

24. A method of transferring an image to a receptor element which comprises the steps of:

(a) forming said image on the imaging system of claim 23, (b) positioning the front surface of said image against said receptor element, (c) applying heat to the rear surface of the support to transfer the image to the receptor element; and (d) peeling the support from the receptor element after the imaging system cools.

* * * * *